United States Patent [19]

Chromy

[11] Patent Number: 4,732,219

[45] Date of Patent: Mar. 22, 1988

[54] HAMMER DRILL WITH PNEUMATICALLY DRIVEN PERCUSSION PISTON

[75] Inventor: Franz Chromy, Feldkirch, Austria

[73] Assignee: Hilti Aktiengesellschaft, Fürstfentum, Liechtenstein

[21] Appl. No.: 926,712

[22] Filed: Nov. 3, 1986

[30] Foreign Application Priority Data

Nov. 2, 1985 [DE] Fed. Rep. of Germany ..... 3539030

[51] Int. Cl.[4] ..... B25D 17/00

[52] U.S. Cl. ..... 173/116; 173/171

[58] Field of Search ..... 173/104, 116, 118, 119, 173/126; 92/85 R; 188/276, 277; 60/329

[56] References Cited

U.S. PATENT DOCUMENTS

| | | | |
|---|---|---|---|
| 3,688,848 | 9/1972 | Vick et al. | 176/116 |
| 4,192,391 | 3/1980 | Kastreuz et al. | 173/116 |
| 4,336,847 | 6/1982 | Ito et al. | 173/118 |

FOREIGN PATENT DOCUMENTS

| | | |
|---|---|---|
| 2729596 | 11/1979 | Fed. Rep. of Germany . |
| 2052346 | 1/1981 | United Kingdom . |

*Primary Examiner*—E. R. Kazenske
*Assistant Examiner*—James L. Wolfe
*Attorney, Agent, or Firm*—Toren, McGeady & Associates

[57] ABSTRACT

A hammer drill has a cylinder within a housing with the cylinder forming a piston chamber. A drive piston is reciprocally mounted within the piston chamber and is displaced by a motor. A percussion piston is located within the piston chamber with an air cushion space located between the two pistons. As the drive piston reciprocates, it moves the percussion piston back and forth by way of the air cushion located between them. One of the pistons has a conduit open at one end to the air cushion space and at the other end to the exterior of the cylinder. A closure plug is located in the one end of the conduit and closes off air flow from the air cushion space into the conduit at regular operating temperatures. If the temperature in the air cushion space rises due to air leakage from the space, the closure plug melts and connects the conduit with the air space so that the reciprocation of the percussion piston stops before the pistons strike against one another and cause damage.

7 Claims, 2 Drawing Figures

HAMMER DRILL WITH PNEUMATICALLY DRIVEN PERCUSSION PISTON

BACKGROUND OF THE INVENTION

The present invention is directed to a hammer drill containing a cylinder forming a piston chamber in which a drive piston is reciprocated by a motor. and a percussion piston within the piston chamber is similarly reciprocated due to an air cushion located between the pistons.

In known hammer drills with a so-called pneumatic percussion mechanism including a drive piston, reciprocated within a piston chamber in the cylinder by a motor, and a percussion piston, reciprocated by an air cushion located between the pistons, a sufficient air cushion may not be available due to increased air leakage losses with resultant damage to the percussion mechanism and also to the drive elements of the percussion mechanism and to other parts of the device, if the pistons strike against one another. The leakage losses result from insufficient sealing between the piston and the cylinder forming the piston chamber, particularly due to wear of the piston sealing elements. Further, inadequate lubrication and the failure of the sealing elements, which may be heat sensitive, tends to cause leakage losses.

To avoid expensive damage beyond the percussion mechanism due to leakage losses, in a known hammer drill disclosed in German Offenlegungsschrift No. 2 729 596, a base part is provided in the drive piston which collapses when it impacts against the percussion piston. As a result the air flows out of the air cushion space between the two pistons so that the percussion piston can no longer be reciprocated.

A disadvantage of such an arrangement is that damage to the parts of the hammer drill may occur when the two pistons impact against one another, which impact is necessary to collapse the base part.

SUMMARY OF THE INVENTION

Therefore, the primary object of the present invention is to provide a hammer drill with a pneumatic percussion mechanism which avoids any damages which might result from leakage losses of the air cushion.

In accordance with the present invention, at least one of the pistons is provided with a conduit connected at one end to the air cushion and at the other end to the exterior of the air cushion and closing the one end of the conduit with a closure plug formed of a material having a low melting point.

The present invention is based on the knowledge that the output of the percussion piston decreases as a result of leakage losses. Since the output supplied to the drive piston by the motor remains unchanged, the thermal output of the percussion mechanism increases as the leakage losses increase and the operating temperature within the air cushion space increases as a whole.

At regular operating temperature or at starting temperature, which lies below the latter, the conduit is kept closed by the closure plug. If a temperature increase is experienced, for example, by 20% relative to the regular operating temperature, the closure plug melts. Accordingly, the conduit is open and the air flows out of the air cushion rendering it ineffective.

In selecting material for the closure plug, it must be taken into account that the melting takes place at a time before the pistons strike against one another. In addition, adequate sealing before melting occurs must be ensured by a suitable selection of the thermal expansion coefficient, that is, the thermal expansion coefficient of the closure plug is approximately equal to or greater than that of the pistons. The percussion piston which is pneumatically disengaged from the drive piston when the closure plug melts, assumes a neutral or rest position independent of any further reciprocation of the drive piston.

A sudden disruption of the percussive output can be noted by the hammer drill operator when the closure plug melts. Consequently, he can stop the hammer drill. Accordingly, damage to the drive elements for the percussion mechanism or to other parts of the device can be prevented. The hammer drill can be returned to operating condition without any damage by replacing the closure plug and effecting any additional maintenance measures which may be necessary, such as replacing the sealing elements and lubricating the percussion mechanism. Preferably, the conduit is formed as a borehole extending through the piston in its axial direction. To afford a uniform weight distribution of the piston, the conduit extends centrally through the piston or is formed by a plurality of boreholes arranged symmetrically relative to the piston axis.

Advantageously, the closure plug is located in the end face of the piston directed toward the air cushion. This end surface on the piston is located in the region in the device exposed directly to increased temperature so that the closure plug is directly influenced by any temperature increase. Accordingly, a sensitive and precise reaction of the closure plug is ensured at different ambient temperatures of the device.

Another feature of the invention is the manner in which the closure plug is secured in the conduit or borehole. Preferably, it is fitted into the bore in a form-locking manner by means of interengaging lands and recesses. Such lands and recesses can be formed as interengaging threaded sections. The closure plug extends into the conduit for a portion of its axial length. The closure plug can be inserted into the conduit as a premolded plug or by means of a casting.

In a preferred embodiment of the invention, the closure plug is located in the drive piston. This arrangement is particularly advantageous for maintaining a secure fit of the closure plug in the conduit. While the percussion piston is constantly exposed to abrupt braking action as it impacts on the end of the tool, which could lead to displacement of the closure plug, the drive piston reciprocates without any corresponding braking action by means of a crank mechanism.

Preferably, the closure plug is formed of a tin alloy. Such material is particularly suitable, because its coefficient of thermal expansion corresponds approximately to the coefficient of thermal expansion of the drive piston which is preferably formed of aluminum. Especially suitable tin alloys are soft solders in accordance with DIN 1707 with selective melting points of 150° to 250° C.

For a better understanding of the present invention, reference is made to the following description and accompanying drawings, while the scope of the present invention will be pointed out in the appended claims.

DETAILED DESCRIPTION OF THE INVENTION

Figures 1, 2:
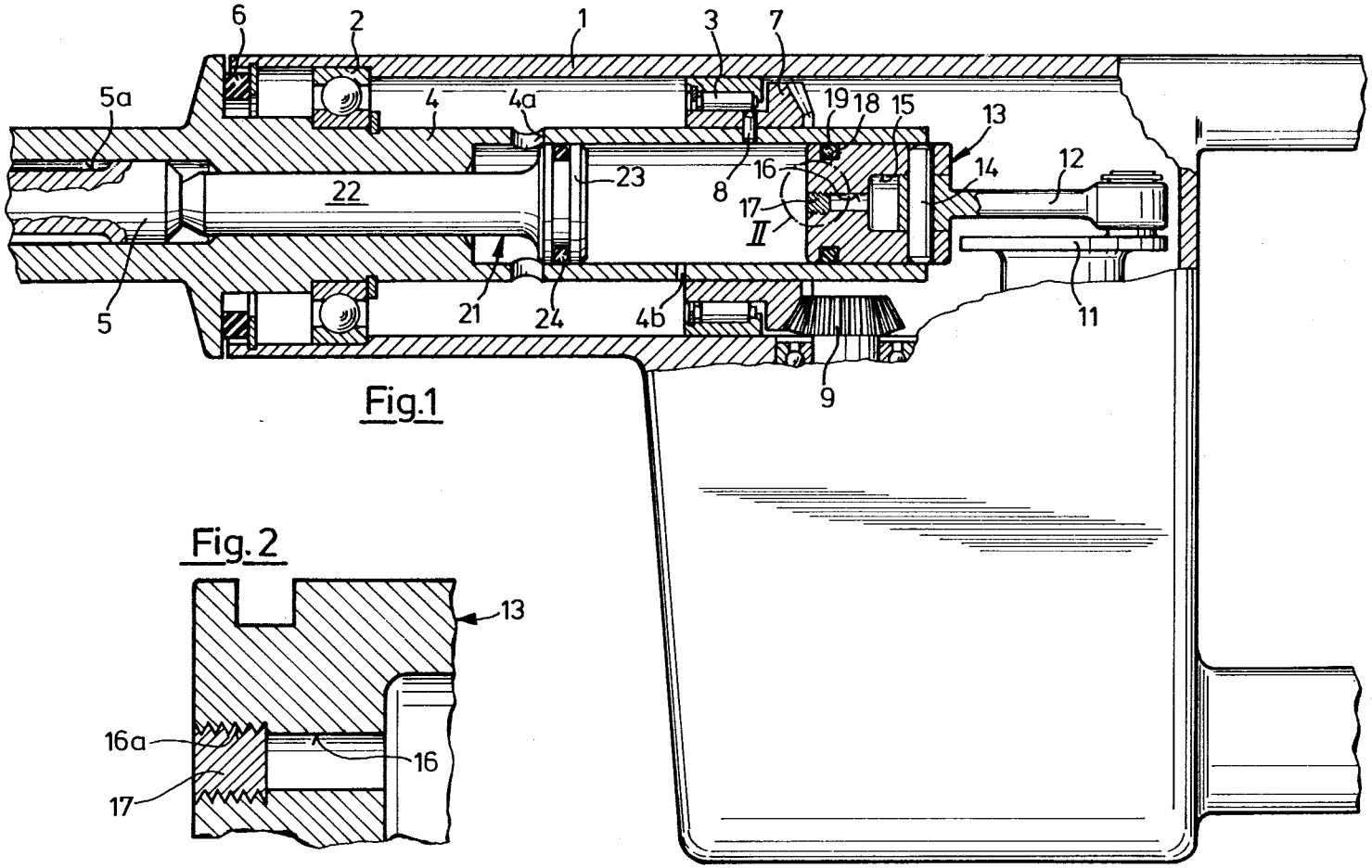
FIG. 1 is a partial elevational view of a hammer drill partly in axially extending section and embodying the present invention.
FIG. 2 is a sectional view of the circled portion II in FIG. 1 and is shown on an enlarged scale.

In FIG. 1, the hammer drill is shown including a housing 1 with a front end in the left hand part of FIG. 1 and a rear end in the right hand part. An axially elongated cylinder is positioned within the housing and extends out of the front end of the housing. The front end portion of the cylinder is not illustrated. The cylinder is rotatably supported within the housing by a ball bearing 2 adjacent the front end of the housing and by a roller bearing 3 closer to the rear end of the housing. The axially extending front region of the cylinder, shown only partly, is formed as a holder for a drill tool 5, shown only in part. The drill tool has grooves 5*a* for engagement with locking elements, not shown. A sealing ring is 6 located within the front end of the housing and bears against a flange-like section extending radially outwardly from the cylinder 4. Sealing ring 6 prevents the passage of dirt into the housing and the loss of lubricants out of the housing.

Toward the rear end of the cylinder 4 within the housing 1, a bevel wheel 7 is secured on the cylinder by a pin 8 so that the bevel wheel and the cylinder rotate as a unit. The drive of the bevel wheel 7 for the rotation of the wheel and the cylinder 4 is effected by a motor-driven bevel pinion 9 in meshed engagement with the wheel. In addition, a crankshaft 11 is secured by a connecting rod 12 to a drive piston 13 which is supported in the rear end of a piston chamber formed within the cylinder 4. A motor, not shown, drives the crankshaft 11 and reciprocates the drive piston 13 within the piston chamber via the connecting rod 12. The connecting rod 12 is secured to the drive piston 13 by means of a pin 14 extending transversely of the axial direction of the cylinder. The end of the connecting rod 12, traversed by the pin 14, is held within a recess 15 in the end of the drive piston outwardly from the piston chamber.

Drive piston 13 is centrally penetrated by a conduit or borehole 16 extending between the end of the piston within the piston chamber and the recess 15. The conduit 16 extends axially in the direction in which the drive piston 13 reciprocates within the cylinder 4. The recess 15 opens to the exterior of the cylinder 4. A closure plug 17 formed of a tin alloy, distinguished by a low melting point, is arranged in the end of the conduit 16 opening into the piston chamber. The closure plug 17 is secured so that it is held in a stable position. Further, an annular sealing element 19 is secured within an annular recess extending around the circumferentially extending surface of the piston 13. The sealing element 19 secured within the recess 18 bears in sliding contact against the inside surface of the cylinder for preventing leakage.

As shown in FIG. 2, the closure plug 17 engages within recesses 16*a* in the piston with the recesses being in the form of a threaded groove so that a form-locking engagement is provided for the closure plug with the piston.

Within the piston chamber in the cylinder 4 there is a percussion piston 21 located closer to the front end of the housing 1. The percussion piston is displaceably supported in the cylinder 4 for reciprocal movement within the cylinder. The percussion piston 21 includes an axially extending shaft 22 shown extending forwardly of the piston chamber for transmitting percussive force to the drilling tool 5 mounted in the front end of the cylinder. Further, a piston head 23 is secured on the end of the shank 22 within the piston chamber. An annular sealing element 24 extends circumferentially around the surface of the piston head 23 in contact with the inside surface of the piston chamber.

As shown in FIG. 1, the piston head 23 is spaced axially within the piston chamber from the drive piston 13 so that an air cushion space is formed between them. Due to the reciprocating action of the drive piston 13, the percussion piston 21 is similarly reciprocated by the air cushion located between the two pistons. To avoid any blockage of the forward movement of the percussion piston 21 as it moves toward the drilling tool 5, apertures 4*a* are provided through the cylinder opening into the forward end of the piston chamber. In addition, spaced rearwardly of the apertures 4*a* there is a compensation hole 4*b* through the cylinder which aids in the periodic build up of the air cushion. As the period of use of the hammer drill increases, the sealing elements 19, 24 lose effectiveness and leakage losses take place with the result that the drive piston 13 and the percussion piston 21 move closer together during the reciprocating movement.

Due to the leakage losses out of the air cushion space, the temperature within the space rises above the regular operating temperature. The melting temperature of the closure plug 17 is selected so that the plug will melt before the two pistons 13, 21 impact against one another. When the closure plug 17 melts, the conduit or borehole 16 is open into the air cushion space within the piston chamber so that the air cushion is dissipated. As a result, the percussion piston 21 is no longer driven or reciprocated by the drive piston 13 which continues to be driven by its motor. The percussion piston remains in an end position in the drilling direction. The hammer drill user will note that the percussive action is no longer transmitted and can immediately stop the hammer drill. Accordingly, costly damage which would occur when the pistons 13, 21 strike one another, is reliably prevented.

To place the hammer drill back in operating condition, certain maintenance must be performed including the insertion of a new closure plug and the replacement of the sealing elements 19, 24.

The described hammer drill is suitable for rotating a drilling tool 5 and at the same time imparting a percussive force to it. Further, the present invention may be used in a device which is arranged only to deliver percussive force to a tool.

While specific embodiments of the invention have been shown and described in detail to illustrate the application of the inventive principles, it will be understood that the invention may be embodied otherwise without departing from such principles.

I claim:

1. Hammer drill comprising a housing having a front end and a rear end, an axially elongated hollow cylinder insertable into said housing through the front end thereof and located within and extending axially in the front end-rear end direction of the housing, said cylinder forming an axially extending piston chamber within said housing, a drive piston displaceably mounted within said piston chamber for movement in the front end-rear end direction of said housing, means for reciprocating said drive piston within said piston chamber, an axially extending percussion piston displaceably mounted within said cylinder and extending into said piston chamber and spaced from said drive piston in the direction toward the front end of said housing, an air cushion space located within said piston chamber between said drive piston and percussion piston, wherein the improvement comprises that at least one of said drive piston and percussion piston comprises a conduit having a first end opening into said air cushion space and a second end opening to the exterior of said cylinder remote from said air cushion space, and a closure plug formed of a material with a selected melting point and located within and closes said conduit, the melting point of the closure plug being lower than the melting point of material forming said drive piston and percussion piston and higher than the normal operating temperature within said air cushion space so that at an increase in temperature above the operating temperature within said air cushion space, said closure plug melts rendering the air cushion space ineffective whereby further reciprocation of said drive piston fails to reciprocate said percussion piston and said drive and percussion pistons cannot strike one another.

2. Hammer drill, as set forth in claim 1, wherein said conduit is formed as an axially extending borehole extending through the at least one said pistons in which it is located.

3. Hammer drill, as set forth in claim 1 or 2, wherein said closure plug is located in an end surface of the at least one said piston facing into said air cushion space.

4. Hammer drill, as set forth in claim 3, wherein said closure plug is secured within said conduit in a form-locking manner by interengaging lands and recesses.

5. Hammer drill, as set forth in claims 1 or 2, wherein said conduit and said closure plug are located within said drive piston.

6. Hammer drill, as set forth in claim 5, wherein said closure plug is formed of a tin alloy.

7. Hammer drill, as set forth in claims 1 or 2, wherein said closure plug is formed of a tin alloy.

* * * * *